US005983403A

United States Patent [19]

Neeley

[11] Patent Number: 5,983,403

[45] Date of Patent: Nov. 16, 1999

[54] METHOD AND APPARATUS FOR A MULTI-FUNCTIONAL WAIST BELT

[76] Inventor: David A. Neeley, Rte. 1, Hwy. 64 - Box 522, Ocoee, Tenn. 37361

[21] Appl. No.: 09/246,393

[22] Filed: Feb. 9, 1999

[51] Int. Cl.[6] ..... A41F 9/00

[52] U.S. Cl. ..... 2/338; 2/339

[58] Field of Search ..... 2/338, 339, 336, 2/341, 342, 311, 312, 300, 183, 181.6, 182.6, 195.2; 224/910, 917, 675, 258, 257; 24/31 R, 31 L, 466, 464, 559, 573.1; D2/627, 634, 636, 638, 639

[56] References Cited

U.S. PATENT DOCUMENTS

| | | | |
|---|---|---|---|
| D. 253,258 | 10/1979 | Clark | D2/638 |
| D. 255,397 | 6/1980 | Button | D2/637 |
| D. 286,581 | 11/1986 | Panth | D2/636 |
| 698,005 | 4/1902 | Geisenheimer | 2/338 |
| 2,885,685 | 5/1959 | Carr et al. | 2/338 |
| 3,748,699 | 7/1973 | Cunningham | 24/31 R |
| 4,602,389 | 7/1986 | Brown | 2/269 |
| 5,337,417 | 8/1994 | Whiteside et al. | 2/338 |
| 5,413,262 | 5/1995 | Dewire et al. | 2/338 |

FOREIGN PATENT DOCUMENTS

| | | | |
|---|---|---|---|
| 209421 | 11/1956 | Australia | 2/338 |

*Primary Examiner*—Amy Vanatta
*Attorney, Agent, or Firm*—Richard C. McComas

[57] ABSTRACT

A multi-function retaining device in which the retaining of articles of clothing is accomplished by an elongated member that has overlapping ends. One end of the elongated member has a series of outwardly extending U-shaped members connected thereon. The other end of the elongated member has a series of apertures disposed therein. When the two ends are overlapped, the U-shaped members traverse the apertures. A second elongated member connected to the first elongated member traverses the U-shaped members, securing the two ends of the first elongated member.

13 Claims, 9 Drawing Sheets

METHOD AND APPARATUS FOR A MULTI-FUNCTIONAL WAIST BELT

FIELD OF THE INVENTION

The invention generally relates to a method and an apparatus for retaining wearing apparel about a person's body. In particular the invention relates to a multi-functional retaining device for retaining wearing apparel about a person's body. More particularly the invention relates to a waistbelt for retaining wearing apparel about a person's body.

BACKGROUND OF THE INVENTION

Various types of wearing apparel have traditionally required some type of retaining mechanism to secure the wearing apparel about the body of a wearer. This mechanism may be a built-in part of the apparel such as permanently attached buttons, zippers, clasps, or other attached securing mechanisms. Non-permanently attached securing mechanisms of various types and designs have also been employed to secure wearing apparel about the body of the wearer. Examples of non-permanently attached securing mechanisms are straps, suspenders, elastic straps, rope cut to size, braided or woven material cut to size, or waistbelts.

The waistbelts worn on various parts of a person's body to retain wearing apparel have long been in existence. The waistbelt may be worn about a person's midsection or over the person's shoulder. Waistbelts may be of various types, designs, or configurations. They may be made of a variety of materials but are generally of a continuous length, i.e., a waistbelt has a longitudinal length with a minimum of two oppositely spaced ends, requiring some type of mechanism to secure these two ends together. The mechanism employed to secure the two ends of the waistbelt together may be a pin and buckle, snap, clasp, button, or any other variety of devices. The most commonly employed waistbelt securing device is the standard pin and buckle.

During the securing of the waistbelt generally one end of the waistbelt is overlaid or juxtaposition the other end of the waistbelt. These two ends may be secured in any desired manner such as the aforementioned pin and buckle. If the pin and buckle are selected to secure the two ends of the waistbelt, the buckle itself must be secured to one end of the waistbelt. The pin portion of the buckle typically pierces the other end of the waistbelt and provides the means for securing the two ends of the waistbelt together. The pin in concert with the buckle, when tension is applied provides the waistbelt with the necessary mechanism for securing the two ends together.

The number of apertures punched into the body of the pin and buckle waistbelt through which the buckle pin must protrude determines the exact number of locations to which the waistbelt may be fitted to the wearer i.e., a five-aperture waist belt has exactly five locations to which the pin and buckle waistbelt can be adjusted to fit around the waist of the wearer. This means the spaces between each aperture represent lengths to which the waistbelt cannot be adjusted to fit around the waist of the wearer. This limitation to the number of adjustment locations greatly reduces the wearer's ability to obtain a "most desirable" or "most comfortable" fit.

Securing the opposite ends of the waistbelt in this manner over time generally leaves depressions in the waistbelt itself caused by constant pressure of the buckle on one end of the waistbelt. The buckle pin does not cause damage to the waistbelt, as it only protrudes through an aperture and locks the buckle in place. The damage done to the waistbelt by the buckle is inherent to the use of a pin and buckle mechanism. The constant pressure applied to the body of the waistbelt by the buckle causes a depression, or worn spot, in the length of the waistbelt. This depression is commonly referred to as a "buckle scar". With continued wear, the problem of buckle scaring causes the waistbelt to become increasingly weaker and with time, the waistbelt eventually becomes worn out, or non-functional.

Attempts in the past have been made to correct the above discussed limitations and the buckle scaring problem. One such attempt is illustrated generally at 810, FIGS. 8*a* to 8*d* of the drawings. The waistbelt 810 does not use a typical pin and buckle arrangement to secure the opposite ends of the waistbelt. This waistbelt employs a single protuberance or buckling loop 820 extending outwardly from the proximal end 830 of the waistbelt. This buckling loop 820 traverses buckling slots 840 inserted into the tongue or distal end 850 of the waistbelt. A second retaining mechanism or thong 860 is inserted into the buckling loop 820 to prevent it's retracting from the buckling slots 840 thereby securing the waist belt 810. A third retaining mechanism 870 is positioned on the distal end 850 of waistbelt 810. The third retaining mechanism or slip-loop 870 may traverse the length of waistbelt 810. The only function of the slip-loop 870 is to prevent the distal end 850 and the thong 860 from dropping downward after the securing of the waistbelt 810 is complete.

The slip-loop 870 is an independent, unattached, and unsecured component, and is a functional component of the waistbelt 810. Though fundamental to the waistbelt 810's operation, there are certain malfunctional characteristics of the slip-loop 870 that are inherent in its design and in relation to its functional compatibility with other required components of the waistbelt 810. The slip-loop 870 is not a component of the buckling mechanism of the waistbelt 810, nor does it function to secure the waistbelt around the waist of the wearer. The only intended function of the slip-loop 870 is to prevent the distal end 850 and the thong 860 from dropping downward after they exit the permanently attached buckling loop 820.

In operation, the slip-loop 870 provides only a limited degree of functionality to its intended purpose. With the slip-loop 870 being an unattached and unsecured part of the waistbelt 810, it does not stay secured in any one desired position because the weight of the distal end 850 and thong 860 presses downward on the slip-loop 870, forcing the slip-loop 870 inward until the slip-loop 870 comes to rest against the buckling loop 820. As a result, the closer the slip-loop 870 shifts toward the buckling loop 820, the further the ends of the distal end 850 and thong 860 drop downward. This progressive inward shifting of the slip-loop 870 eventually renders the slip-loop 870 unable to perform the function for which it was intended.

It would be desirable to have a multi-functional waistbelt that had two opposing ends and a securing mechanism distributed on both ends of the waistbelt. Once the two ends were secured together, neither end of the waistbelt would droop.

SUMMARY OF THE INVENTION

The preferred embodiment of the present invention is a multi-function retaining device or a waistbelt that is used primarily to retain an article of clothing about an individual's body. The waistbelt may, if desired, traverse belt loops that are connected to the article of clothing. The waistbelt loops are not required for the implementation of the present invention. Once an individual has positioned the waistbelt according to his desire, the waistbelt may be secured by interlacing one end of the waistbelt to the other end of the waistbelt.

The waistbelt may, if desired, comprise a first elongated member that has a proximal end and a distal end. The distal end of the waistbelt has a plurality of holes, slots or apertures that may, if desired, be spaced from the tip of the distal end. The more apertures present in the distal end of the waistbelt the more the adjustablity of the waistbelt. The proximal end of the waistbelt may, if desired, have at least two substantially U-shaped members attached by any convenient means. The U-shape is a matter of convenience. Any desired shape may be used, such as an omega (Ω). Once the waistbelt is positioned about the article to be retained, the distal end of the waistbelt is juxtaposition the proximal end of the waistbelt. The U-shaped members traverse selected apertures and are in position to be secured by a second elongated member.

The second elongated member has a distal end and a proximal end. The proximal end of the second elongated member is secured to the distal end of the waistbelt in any convenient position or manner. Generally, the proximal end of the second elongated member is positioned adjacent to the last aperture as measured from the distal end of the waistbelt. The second elongated member traverses the U-shaped members thereby preventing the U-shaped members from retracting from the distal end of the waistbelt. The waistbelt is now secured about the individual and retains the chosen article of clothing about the individual.

In the second embodiment of the present invention, the waistbelt has a storage compartment for valuables. Once the proximal end of the second elongated member is correctly positioned on the waistbelt, the storage compartment extends bilaterally into the first and second elongated members. The storage compartment is not visible to the casual viewer. An insert slot is provided that allows entry into the storage compartment. The user of the waistbelt may, if desired, use the storage compartment to secure valuables such as properly folded currency.

The third embodiment of the present invention incorporates the features of the previously discussed embodiments plus a plurality of apertures spaced from each end of the waistbelt. The apertures are spaced along their respective ends in any convenient position and they are sized to receive retaining members of musical instruments.

The present invention may be manufactured by selecting a material that has varying degrees of rigidity dispersed within its composition. A desired shape of the second elongated member is extracted, cut, or formed from the most rigid portion of the material. A desired shape of the first elongated member is extracted, cut, or formed from the remaining material. The first elongated member is cut from the material in such a way as to provide the distal end of the first elongated member with substantially more rigidity than its proximal end. The distal end of the first elongated member has a plurality of holes, slots, or apertures formed or cut therein.

Preferably, the second substantially rectangular member is cut from the most rigid end of the material but if desired this member may be cut from the same rigidity of material as the first elongated member. The second elongated member is formed or cut to size in such a way that it may have a width less than or equal to the interior dimension of the U-shaped members. The proximal end of the second elongated member is now connected to the first elongated member. Generally, the second elongated member is spaced from the last aperture as measured from the distal end of the first elongated member.

A plurality of rectangular members may be cut from rawhide (or other material) and formed into substantially U-shaped members. The U-shaped members are connected along one end of the first elongated member by any convenient means. The positioning of the U-shaped members is a matter of convenience but generally, they are spaced from the proximal end of the first elongated member. The waistbelt is now manufactured and is ready to be secured about an individual as discussed herein.

When taken in conjunction with the accompanying drawings and the appended claims other features and advantages of the present invention will become apparent upon reading the following detailed description of embodiments of the invention.

BRIEF DESCRIPTION OF THE DRAWINGS

The invention is illustrated in the drawings in which like reference characters designate the same or similar parts throughout the figures of which.

DESCRIPTION OF THE PREFERRED EMBODIMENTS

Figure 1:
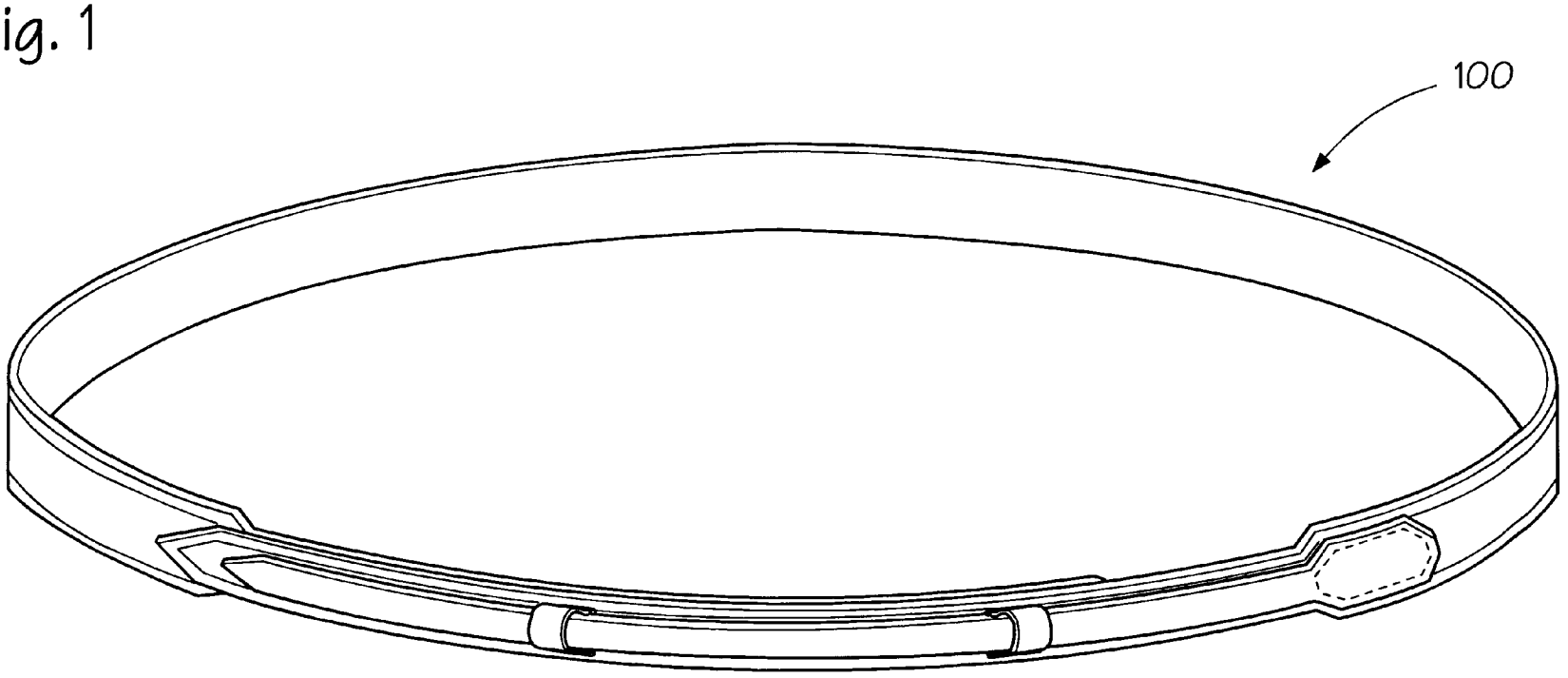
FIG. 1 illustrates a perspective view of the preferred embodiment of the present invention.

The present invention is a retaining member or device generally illustrated at 100, FIG. 1. The retaining device 100 traverses an object of any type to be retained and then secures that object. The present invention provides a multi-member securing mechanism that secures the retaining device 100 about an object or a person. Retaining device 100 may, if desired, be used to retain articles of clothing or wearing apparel about the body of an individual person. The individual may place retaining device 100 on any desired part of his person and secure the wearing apparel about that part of his body. The retaining device 100 may, if desired, be placed in direct contact with the individual, or may, if desired, be placed over the wearing apparel for securing the wearing apparel to that person. The individual may be an adult, child, male or female. The retaining device 100 may, if desired, be positioned or attached to an object or person for decorative purposes without the intent of securing any material about that object or person. Examples of objects may be handbags, wallets, over the shoulder bags, shoes, dresses, pants, shirts, backpacks, and other types of garments known to an ordinary person skilled in the art.

Figure 2A:
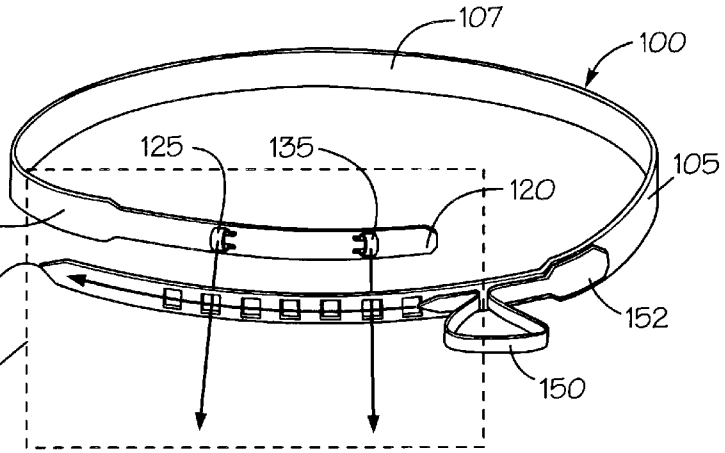
FIG. 2*a* illustrates an expanded perspective view of FIG. 1.

The present invention comprises, in part, an elongated retaining member 105, FIG. 2*a*. The geometry of elongated retaining member 105 may, if desired, be substantially rectangular and elongated or any other suitable shape. The elongated retaining member 105 has an exterior surface 108 and an interior surface 107. The exterior surface 108 and the interior surface 107 of the elongated retaining member 105 may, if desired, be cut, formed, or molded together such that the edges of the exterior surface 108 and the interior surface 107 are seamless. The elongated retaining member 105 may, if desired, be manufactured from any type of suitable material. The material may, if desired, be of homogeneous composition, multi-composition of varying degrees, or laminated material. The material may, if desired, be rigid or have varying degrees of rigidity disposed along its longitudinal length. The material may be selected from leather, cloth, plastic, steel, wood, or other material. The length of the elongated retaining member 105 may be of any desired dimension to accommodate the needs of securing or adornment. The elongated retaining member 105 has a distal end 110 and a proximal end 120. The distal 110 and proximal 120 ends may, if desired, be tapered.

The positioning of the elongated retaining member 105 for securing requires its distal end 110 to be juxtaposition its proximal end 120. The positioning, placement, or angular relationship of the distal end 110 to the proximal end 120 of the elongated retaining member 105 is relative depending on the desire and nature of the securing of the wearing apparel or object.

Figure 2B:
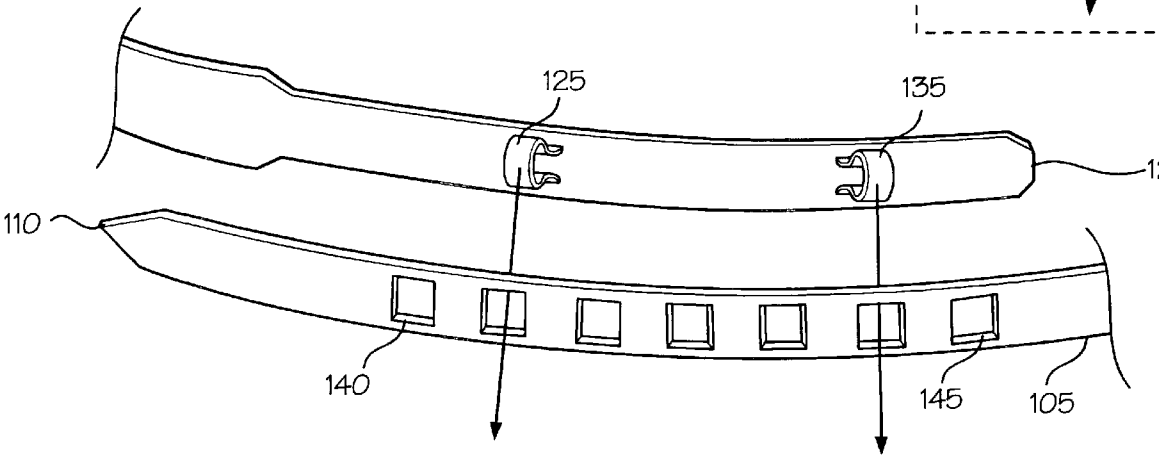
FIG. 2*b* illustrates an expanded perspective view of the distal end of the preferred embodiment juxtaposition the proximal end of the preferred embodiment of FIG. 2*a,*
Figure 5:
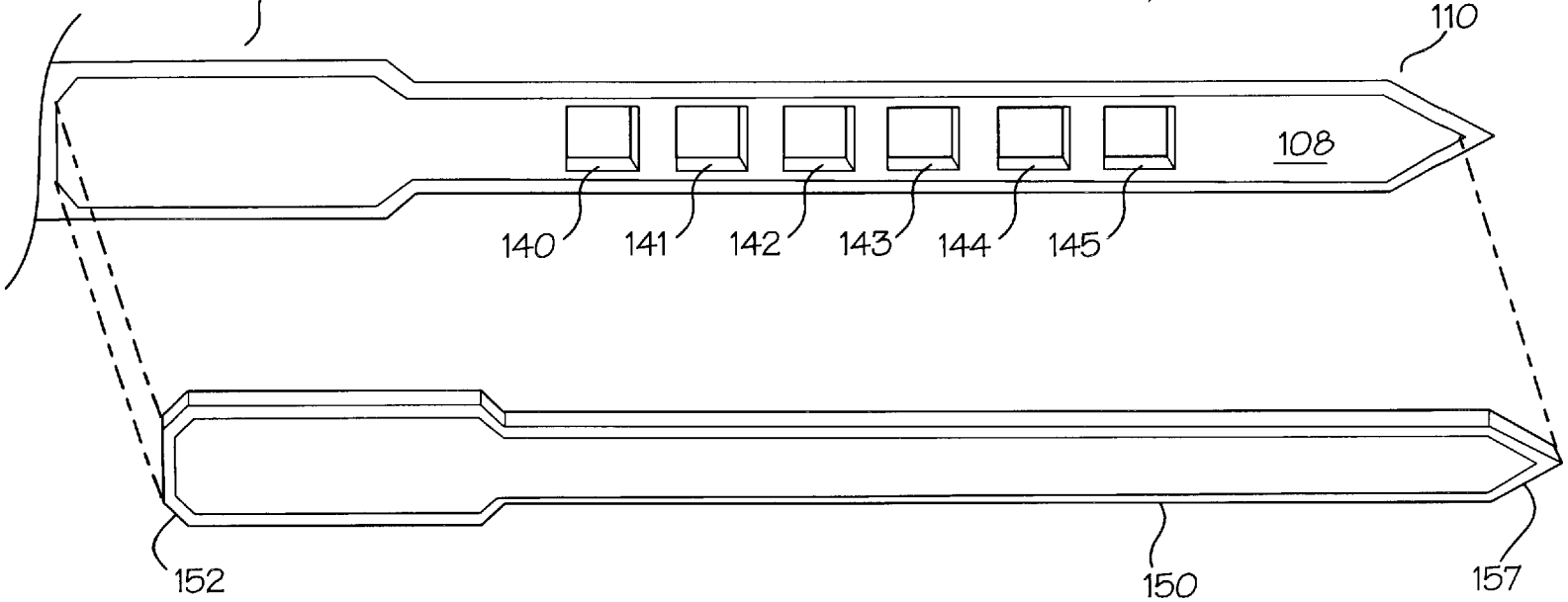
FIG. 5 illustrates a plan view of the distal end of FIG. 3*b,*

A securing mechanism is employed to secure the distal end 110 to the proximal end 120, FIGS. 2*a,* 2*b,* and 2*c*. The securing mechanism comprises a flexible elongated member 150 that is connected to and spaced from the distal end 110 of elongated retaining member 105. Flexible member 150, FIG. 5, has a distal end 151 and a proximal end 152. Flexible member 150, FIG. 2*a* may, if desired, be sized to overlap or fit within the confines of distal end 110 of the elongated retaining member 105. Flexible member 150 may, if desired, contain the same taper as retaining member 105. At least two U-shaped members, 125 and 135, FIG. 2*b,* are connected to and conveniently spaced from the proximal end 120 of the elongated retaining member 105.

Figure 2C:
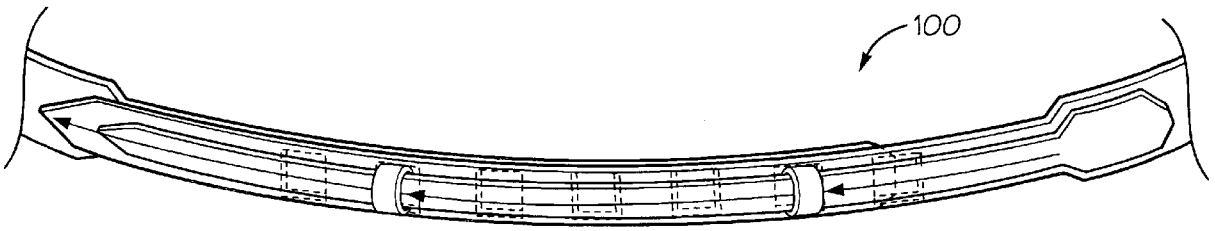
FIG. 2*c* illustrates a perspective view of the distal end of the preferred embodiment abutting the proximal end of the embodiment of FIG. 1.

The U-shaped members 125 and 135 are preferably constructed or made from rawhide leather (or other rigid material) or if desired they may be made from the same material as the elongated retaining member 105. The distal end 110 of the elongated retaining member 105 has a plurality of apertures 140 to 145, FIG. 2*b*. The apertures are sized to receive the U-shaped members 125 and 135. The U-shaped members 125 and 135 traverse selected apertures 140 to 145 and outwardly extend from the exterior surface 108. Flexible member 150 is sized to traverse the interior portion of the U-shaped member 125 and 135. Flexible member 150, FIG. 2*c,* secures the distal end 110 to the proximal end 120 of the elongated retaining member 105 by preventing the U-shape members 125 and 135 from retracting from the selected apertures 140 to 145.

Figure 3A:
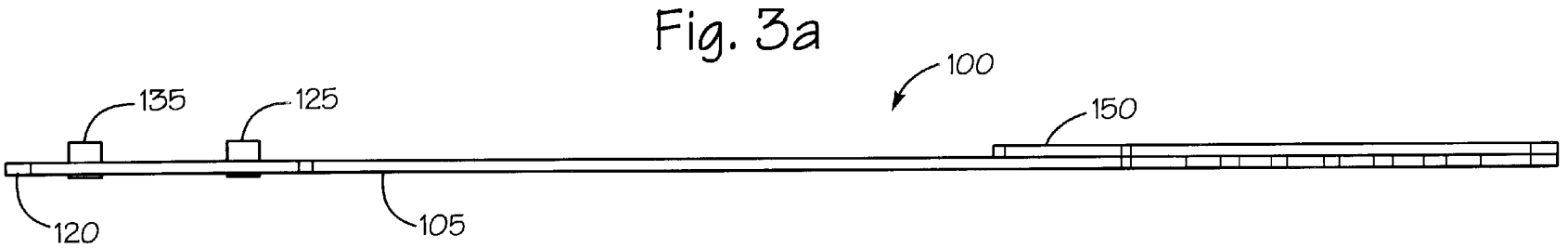
FIG. 3*a* illustrates a side view of the preferred embodiment of FIG. 1.
Figure 3B:
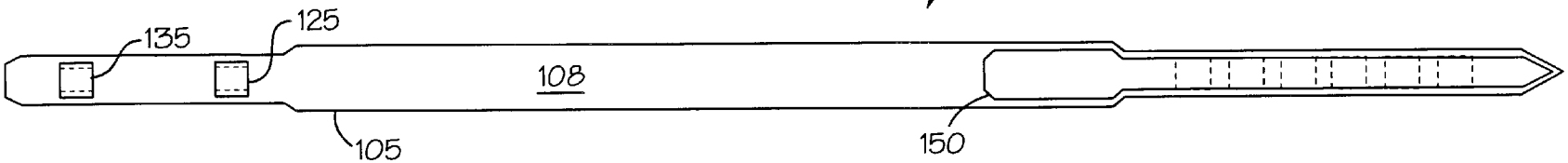
FIG. 3*b* illustrates an exterior view of the preferred embodiment of FIG. 3*a,*
Figure 3C:
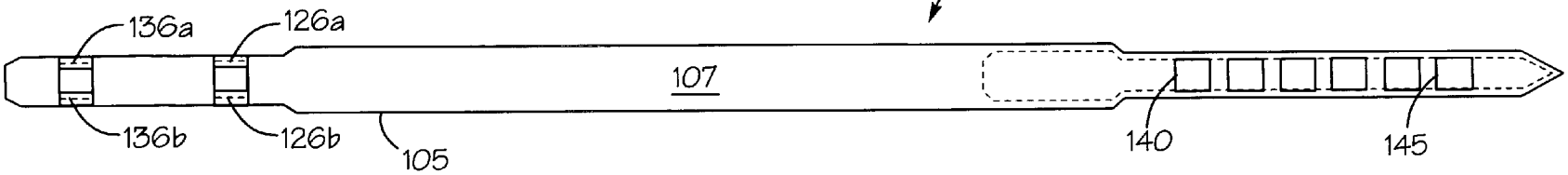
FIG. 3*c* illustrates an interior view of the preferred embodiment of FIG. 3*a,*
Figure 4:
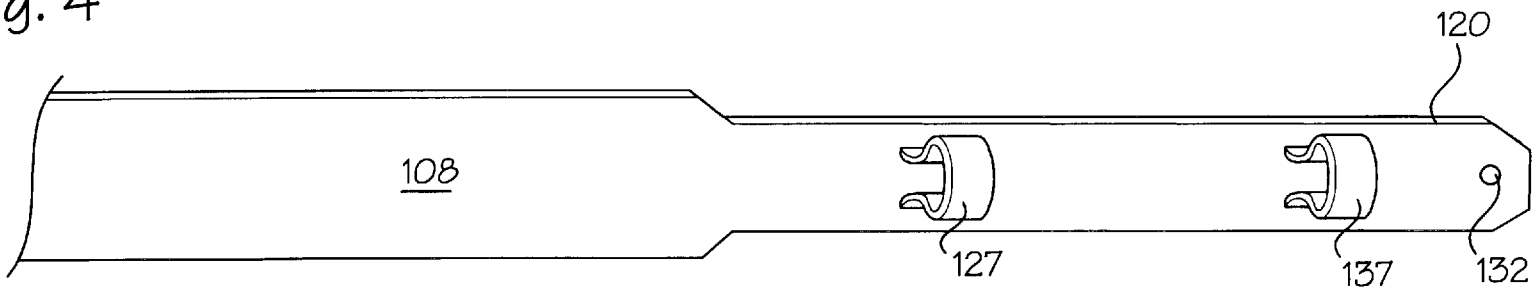
FIG. 4 illustrates a plan view of the proximal end of FIG. 3*b,*

The U-shaped members 125 and 135, FIG. 3*a* extend outwardly from the elongated retaining member 105. The method of attachment may be of any suitable mechanism that allows the U-shaped members 125 and 135 to be attached to the elongated retaining member 105, FIG. 3*b*. An example of this attachment mechanism would be gluing, sewing, pressing, or molding. The U-shaped members 125 and 135, FIG. 3*c,* have outwardly extending feet 126*a,* 126*b,* and 136*a,* 136*b,* respectively. The outwardly extending feet 126*a,* 126*b,* and 136*a,* 136*b* may, if desired, be used to connect U-shaped members 125 and 135 to the elongated retaining member 105. The U-shaped members are not restricted to a U-shape and may be of any desired geometry or shape that allows flexible member 150 to traverse therethrough. An illustration of a varying shape is an omega (Ω) shape 127 and 137, FIG. 4. If desired a hanger aperture or aperture 132 may be inserted into the proximal end 120 to store the present invention on a peg, knob or hanger. The hanger aperture 132 may be any convenient size to accommodate the peg, knob, or hanger.

Figure 6A:
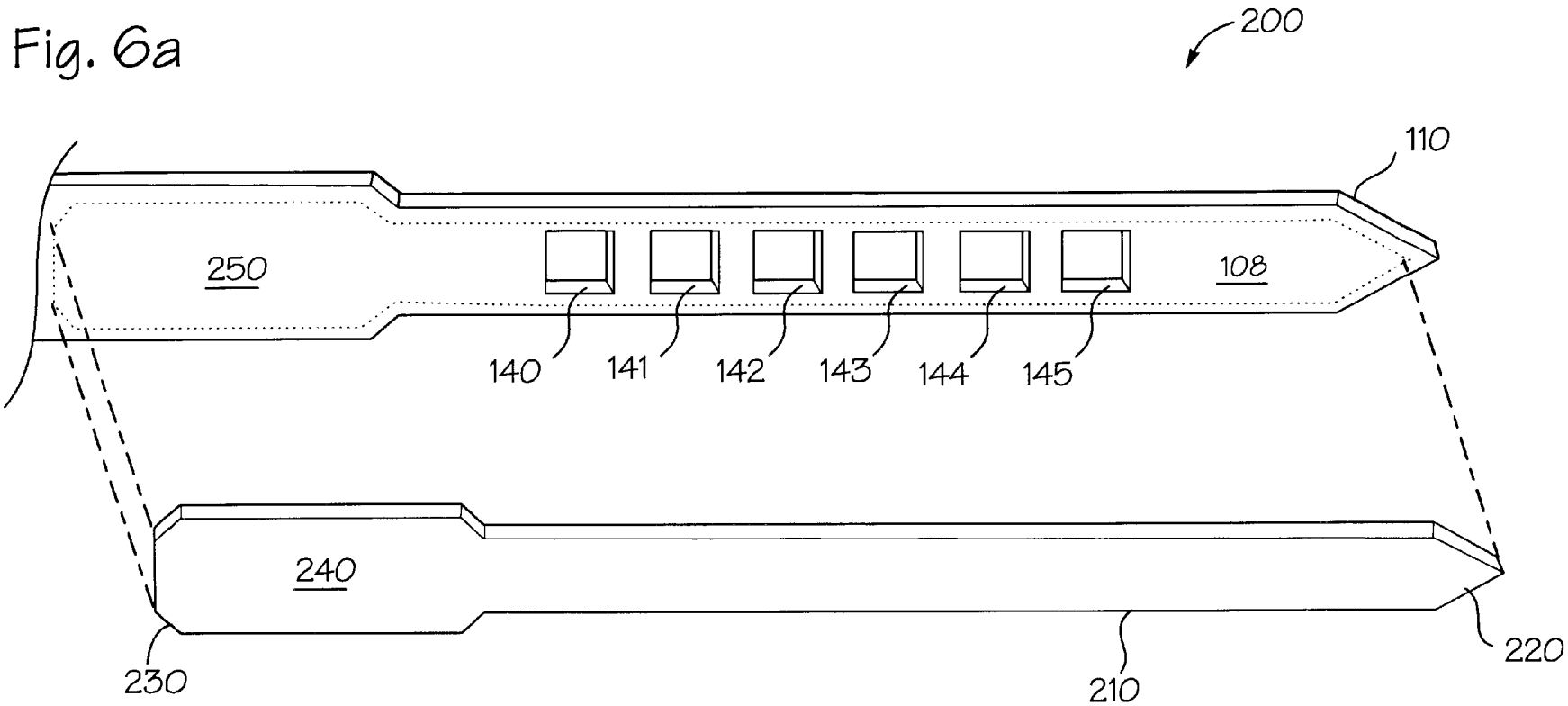
FIG. 6*a* illustrates a plan view of the second embodiment of the present invention.
Figure 6B:
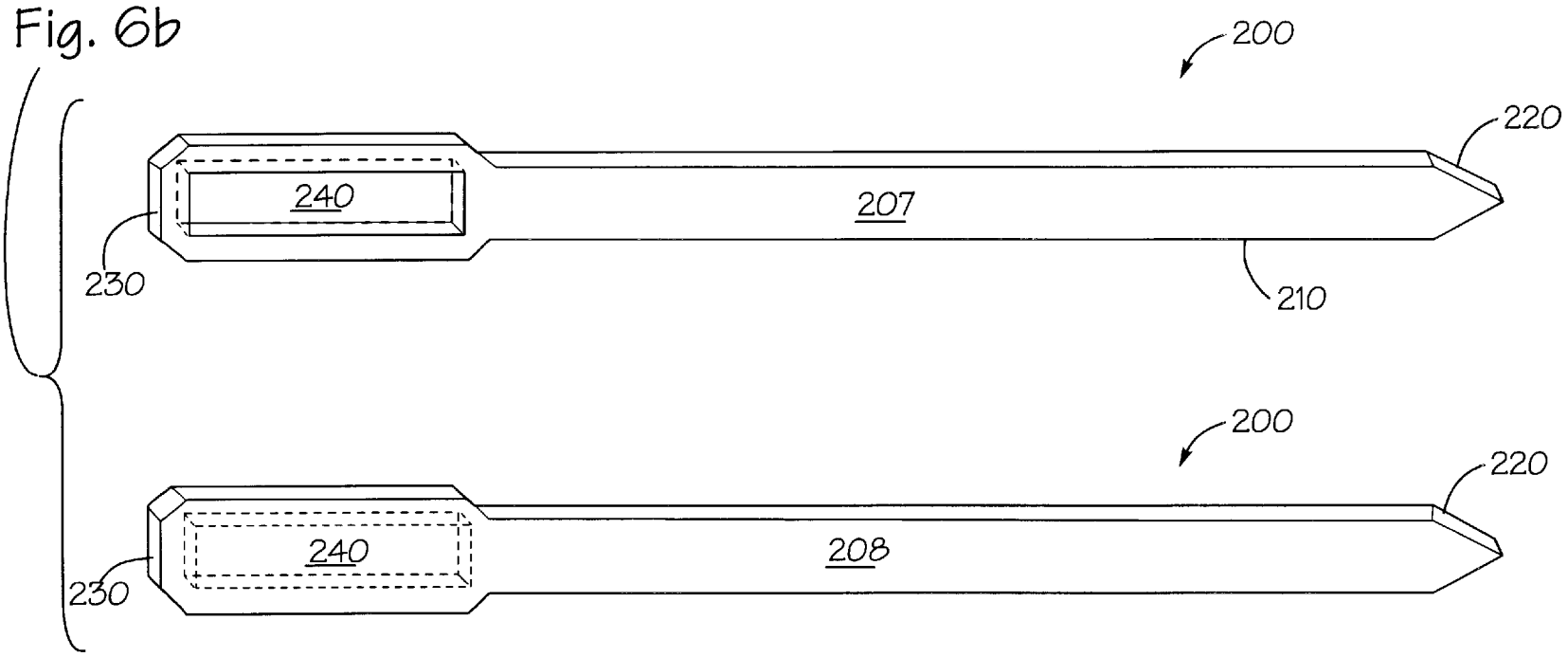
FIG. 6*b* illustrates a plan view of FIG. 6*a,*

A second embodiment of the present invention is a compartment for storing money or other valuables, generally illustrated at 200, FIGS. 6*a,* 6*b,* and 7. The second embodiment has a flexible member 210. The flexible member 210 has a distal end 220 and a proximal end 230. Flexible member 210 has an interior surface 207 and an exterior surface 208. The thickness of flexible member 210 may, if desired, be selected to allow the hollowing or carving out of an area that would create a cavity 240. The hollowed area has sidewalls that surround the cavity 240. The cavity 240's sidewalls may, if desired, be orthogonal to adjacent walls or the sidewalls may be sculpted to any desirable size. The cavity 240 may be spaced any convenient distance from the proximal end 230 of the flexible member 210.

A second cavity 250, FIG. 6*a,* corresponding in volume to cavity 240 may, if desired be hollowed or carved out of an area of the flexible member 105. The hollowed area has sidewalls that surround the cavity 250. The cavity 250's sidewalls may, if desired, be orthogonal to adjacent walls or the sidewalls may be sculpted to any desirable size.

Figure 7:
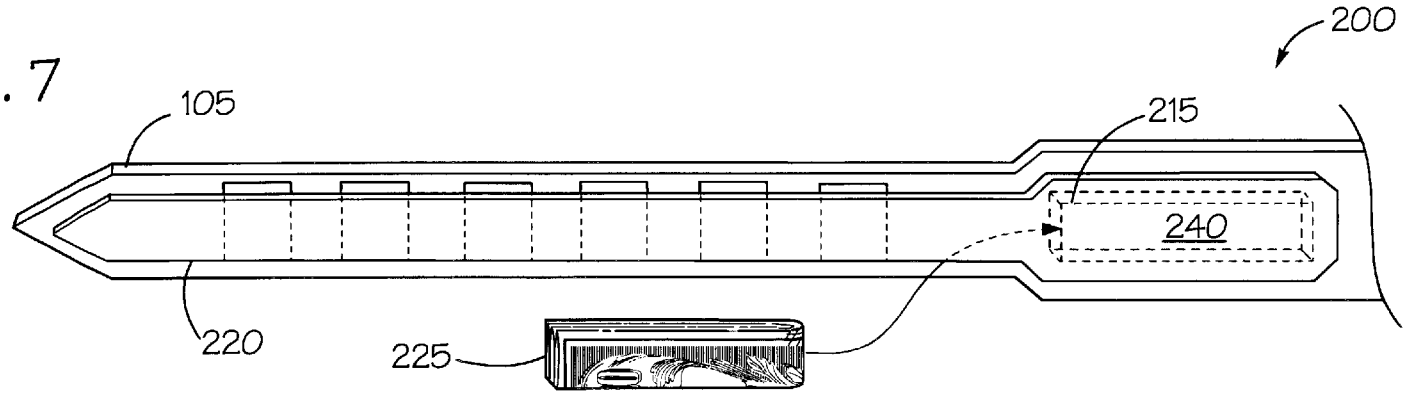
FIG. 7 illustrates a plan view of the second embodiment of FIGS. 6*a* & 6*b* in actual use.
Figure 8A:
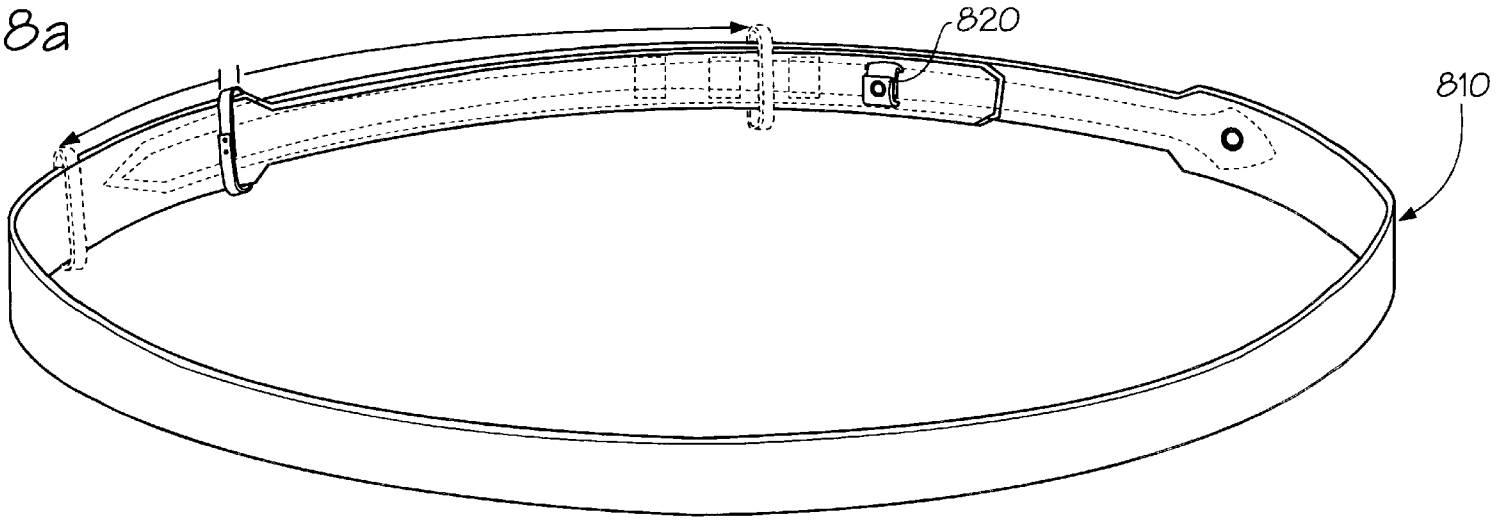
FIG. 8*a* illustrates a perspective view of a slip-loop waistbelt.
Figure 8B:
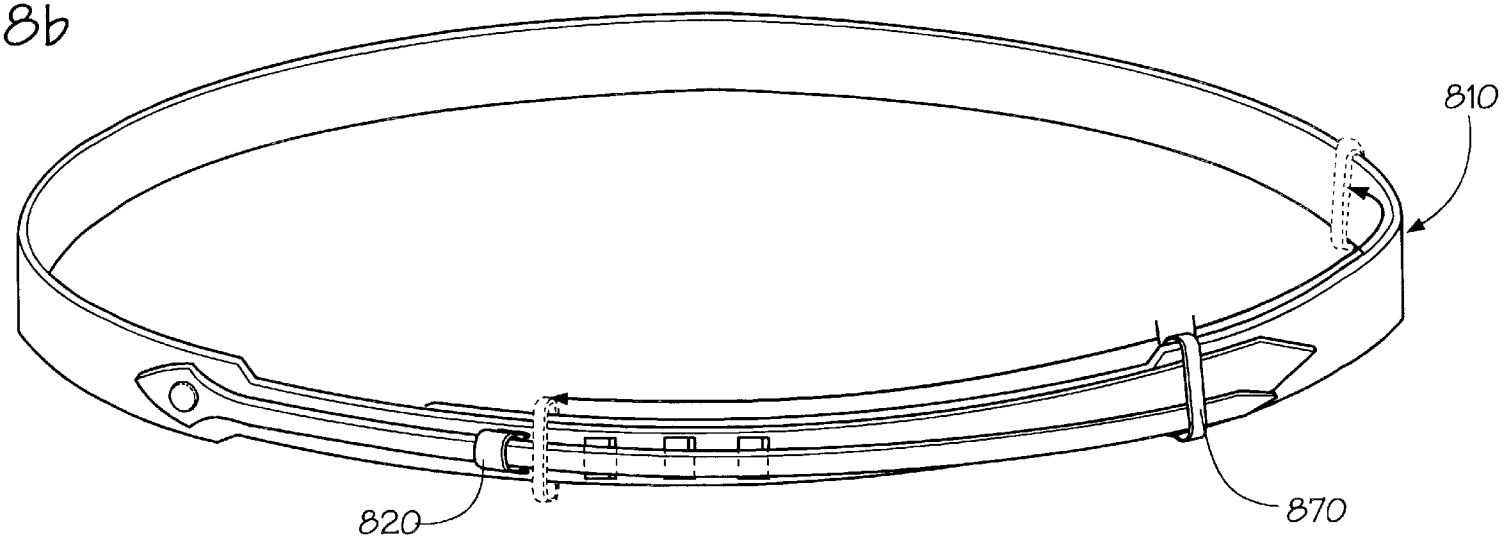
FIG. 8*b* illustrates a perspective view of the exterior of the slip-loop waistbelt of FIG. 8*a,*
Figure 8C:
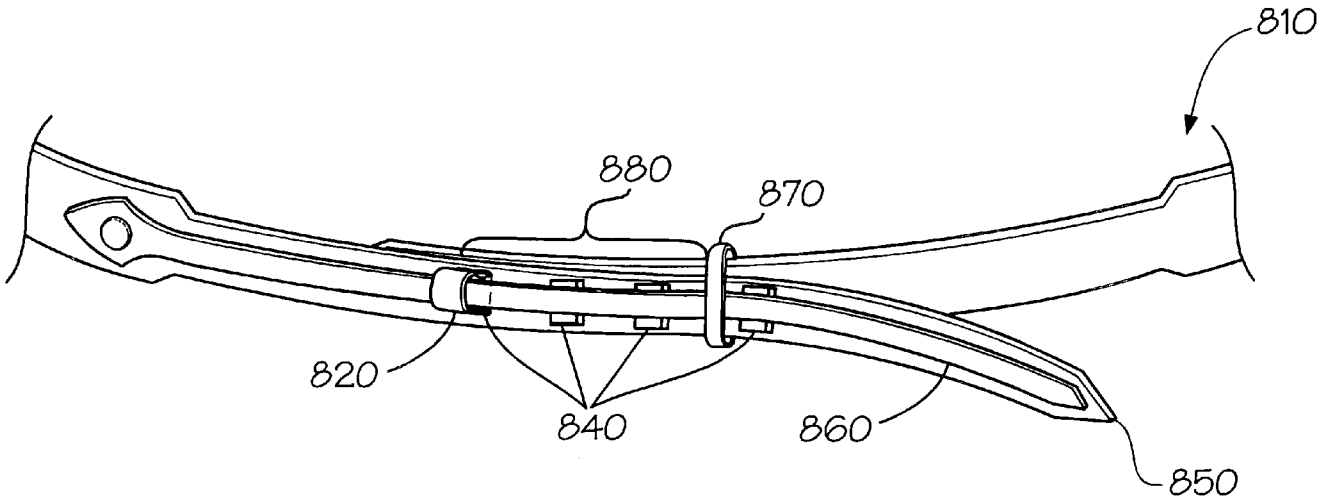
FIG. 8*c* illustrates a perspective view of the front section of the slip-loop waistbelt of FIG. 8*b,*
Figure 8D:
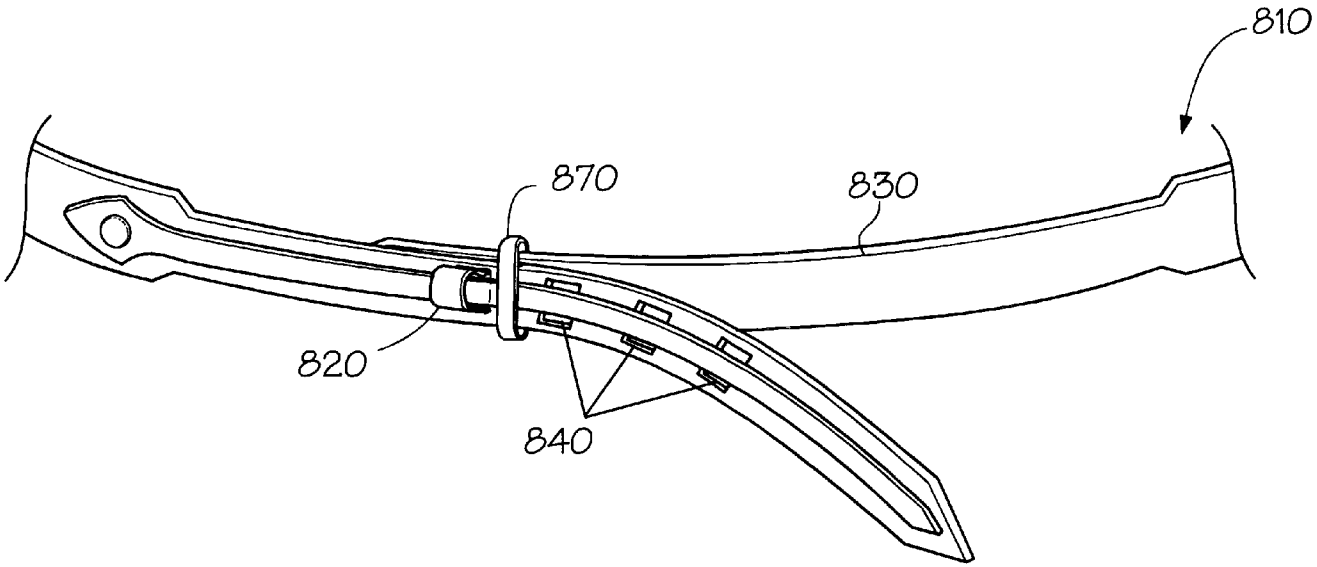
FIG. 8*d* is a perspective view of the slip-loop waistbelt illustrated in FIG. 8*c* in normal operation.

Flexible member 210 is secured to the elongated retaining member 105 in such a way as to allow cavity 240 to overlay cavity 250. The opposing cavities 240 and 250 create a suitable volume for storing various types of valuables. Access to the interior of the opposing cavities 240 and 250 is a slot or aperture 215, FIG. 7, cut into one of sidewalls of cavity 240 or 250. An example of the storage use of the present invention is a dollar bill 225 properly folded and inserted into opposing cavities 240 and 250 via slot 215.

Figure 9:
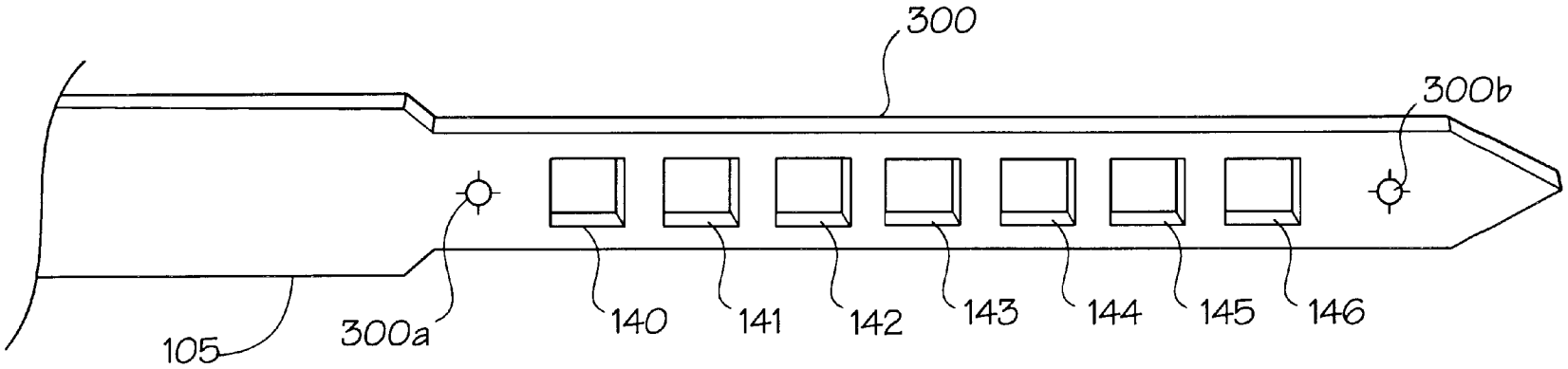
FIG. 9 illustrates a plan view of the third embodiment of the present invention, FIG. 10 Illustrates a plan view of the proximal end of the third embodiment of FIG. 9.
Figure 10:
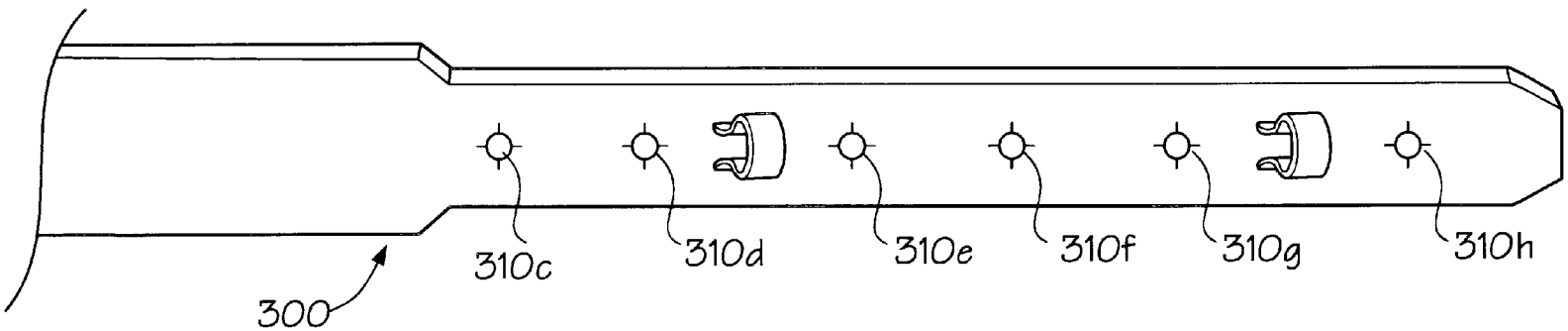

A third embodiment of the present invention is a musical instrument belt, generally illustrated at 300, FIGS. 9 and 10. The musical instrument belt 300 has a plurality of holes or apertures 300*a* and 300*b* that are inserted into the distal end 110 of the elongated retaining member 105. The musical instrument belt 300 has a second set of holes or apertures 310*c* to 310*g,* FIG. 10, inserted into the proximal end 120 of the elongated retaining member 105. The apertures are spaced along their respective ends in any convenient position and they are sized to receive retaining members of a musical instrument. An example of retaining members is the receiving knobs on a guitar. The musical instrument belt 300 may, if desired, be used in place of a standard guitar strap.

A method of manufacturing the present invention may, if desired, comprise selecting a material that has varying degrees of rigidity dispersed within its composition. A desired shape of the second elongated member 150 is extracted, cut, or formed from the most rigid portion of the material. A desired shape of the first elongated member 105 is extracted, cut, or formed from the remaining material. The first elongated member 105 is cut from the remaining material in such a way as to provide the distal end 110 of the first elongated member 105 with substantially more rigidity than the proximal end 120 of the first elongated member 105. The distal end 110 of the first elongated member 105 has a plurality of holes, slots, or apertures formed or cut therein.

A plurality of rectangular members may be cut from rawhide (or other suitable material) and formed into substantially U-shaped members and denoted 125 and 135. The U-shaped members 125 and 135 are connected along one end of the first elongated member by any convenient means. The positioning of the U-shaped members is a matter of convenience but generally, they are spaced from the proximal end 120 of the first elongated member 105.

Preferably, the second substantially rectangular member 150 is cut from the most rigid end of the material, but if desired, this member may be cut from the same rigidity of material as the first elongated member 105. The second elongated member 150 is formed or cut to size in such a way that it may have a width less than or equal to the interior dimension of the U-shaped members 125 and 135. The proximal end 152 of the second elongated member 150 is connected to the first elongated member 105. Generally, the second elongated member 150 is spaced from the last aperture 145 as measured from the distal end 110 of the first elongated member 105. The waistbelt is now manufactured and is ready to be secured about an individual as discussed herein.

The selection of appropriate materials for manufacturing as discussed above allows the present invention to have a contiguous adjustment zone. The contiguous adjustment zone is self-adjusting and/or manually adjustable over a selected range. Ordinarily a buckle and pin or a slip-loop waistbelt is adjusted to a fixed size, i.e.; the pin traverses the waistbelt at a given location and once the waistbelt engages the buckle, the adjustment is fixed. The present invention not only uses the U-shaped members 125 and 135 working in concert with the apertures 140 to 145 in conjunction with the second elongated member 150, it also utilizes the space between the apertures 140 to 145 for adjustment. The adjustment comprises selecting a desired initial adjustment for the present invention. The present invention maintains this adjustment until stress is applied. This stress may be applied by a meal consumption or by any other waist expansion that may cause the present invention to reside in a position unintended by the initial adjustment. This repositioning causes the stretching of the present invention to be equal to the distance between selected adjacent apertures 140 to 145. With these considerations determined, the stretch of each waistbelt is calculated to take place along the body of the first elongated member 105. The first elongated member 105 is selected from the above discussed material in such a way as to provide the proximal end 120 with the least rigidity and the distal end 110 with the most rigidity. Once this selection is made, the present invention may be buckled in one set of apertures and the body of the present invention will stretch the distance of an aperture spacing before it needs to be manually adjusted into the next set of apertures. For example if the initial selected adjustment is set for 34 inches, the present invention may be adjusted to include all lengths between 33 and 35 inches, equating to a minimum contiguous adjustment zone of 2 inches.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. The means-plus-function clause is intended to cover the structures described herein as performing the recited function, the structural equivalents, and the equivalent structures. Thus, although a nail and a screw may not be structural equivalents in that a nail employs a cylindrical surface to secure wooden parts together, and a screw employs a helical surface, in the environment of fastening wooden parts, a nail and a screw may be equivalent structures.

I claim:

1. A retaining device, comprising:

a) a first elongated member having overlapping ends;

b) a plurality of U-shaped members connectively disposed in an interlacing relationship with said overlapping ends;

c) a second elongated member having one end adjacently disposed to one end of said first member;

d) said second elongated member having a second end oppositely spaced from said first end, said second end traversing said U-shaped members thereby releasably securing said overlapping ends.

2. A retaining device as recited in claim 1 wherein said U-shaped members having outwardly extending end points thereby facilitating connection of said U-shaped members to said first elongated member.

3. A retaining device as recited in claim 2 wherein said first elongated member is composed of material having varying degrees of rigidity.

4. A retaining device as recited in claim 3 wherein said second elongated member is composed of rigid material.

5. A retaining device as recited in claim 4 further comprising an externally accessible storage compartment bounded by sidewalls disposed in one end of said first elongated member and said second elongated member.

6. A retaining device as recited in claim 5 wherein said sidewalls in said first elongated member form one half of said storage compartment.

7. A retaining device as recited in claim 6 wherein said sidewalls in said second elongated member form the other half of said storage compartment.

8. A retaining device as recited in claim 7 wherein said first elongated member having at least one aperture connectively disposed along its longitudinal length, said aperture sized to receive a receptacle for hanging the retaining device.

9. A retaining device as recited in claim 7 wherein said first elongated member having at least two apertures operationally disposed along said first elongated members most rigid end.

10. A retaining device as recited in claim 9 wherein said apertures is sized to receive said U-shaped members.

11. A retaining device as recited in claim 10 wherein said apertures is operationally spaced apart thereby providing a contiguous adjustment zone for the retaining device.

12. A retaining device, comprising:

a) a first elongated member having a proximal end and a distal end;

b) said first elongated member having a plurality of apertures positionally disposed from said first elongated member's distal end;

c) at least two substantially U-shaped members spaced apart and connectively disposed on said first elongated member's proximal end, d) said first elongated member's distal end juxtaposition said first elongated member's proximal end;

e) said U-shaped members traversing said apertures;

f) a second elongated member having a proximal end and a distal end;

g) said proximal end of said second elongated member connectively disposed and spaced from said distal end of said first elongated member; and h) said distal end of said second elongated member traversing said U-shaped members thereby securing said distal end of said first elongated member to said proximal end of said first elongated member.

13. A method for manufacturing a retaining device, comprising the steps of:

a) providing a first elongated member, said first member having varying degrees of rigidity disposed along its longitudinal length;

b) selecting the most rigid end of said first elongated member;

c) forming at least one U-shaped member, said U-shaped member operationally and oppositely spaced from said most rigid end of said first elongated member;

d) forming apertures in said first elongated member's most rigid end;

e) selecting a second elongated member having a greater rigidity than said first elongated member;

f) connecting operatively said second elongated member to said first elongated member;

g) overlaying said most rigid end of said first elongated member with said least rigid end, whereby said U-shaped member traverses said aperture; and h) inserting said second elongated member through said U-shaped members thereby securing the retaining device.

* * * * *